US005129541A

United States Patent [19]

Voigt et al.

[11] Patent Number: 5,129,541

[45] Date of Patent: Jul. 14, 1992

[54] EASY OPEN ECOLOGY END FOR CANS

[75] Inventors: Lee R. W. Voigt, Schaumburg; Jeffrey A. Dobrzynski, Bensenville, both of Ill.

[73] Assignee: Buhrke Industries, Inc., Arlington Hts., Ill.

[21] Appl. No.: 710,165

[22] Filed: Jun. 4, 1991

[51] Int. Cl.[5] ..... B65D 17/34

[52] U.S. Cl. ..... 220/269

[58] Field of Search ..... 220/269, 270, 271, 272, 220/273, 276

[56] References Cited

U.S. PATENT DOCUMENTS

| | | | |
|---|---|---|---|
| Re. 31,702 | 10/1984 | Brown . | |
| 3,337,085 | 8/1967 | Bozek . | |
| 3,536,227 | 10/1970 | Markert | 220/273 |
| 3,625,392 | 12/1971 | Kaminski . | |
| 3,726,434 | 4/1973 | Platt . | |
| 3,744,667 | 7/1973 | Fraze et al. | 220/269 |
| 3,795,342 | 3/1974 | Ashton . | |
| 3,838,788 | 10/1974 | Stargell . | |
| 3,850,124 | 11/1974 | Brown . | |
| 3,868,918 | 3/1975 | Smith, Jr. et al. . | |
| 3,891,117 | 6/1975 | Dragomier et al. . | |
| 3,967,752 | 7/1976 | Cudzik | 220/269 |
| 3,967,753 | 7/1976 | Cudzik | 220/269 |
| 3,967,754 | 7/1976 | Ostrem . | |
| 3,977,561 | 8/1976 | Strobe et al. . | |
| 3,986,633 | 10/1976 | Jordan . | |
| 3,989,161 | 11/1976 | Pillnik . | |
| 4,015,744 | 4/1977 | Brown . | |
| 4,024,981 | 5/1977 | Brown . | |
| 4,030,631 | 6/1977 | Brown | 220/269 |
| 4,044,915 | 8/1977 | LaCroce et al. . | |
| 4,084,721 | 4/1978 | Perry . | |
| 4,096,967 | 6/1978 | Kaminski . | |
| 4,130,074 | 12/1978 | Cudzik . | |
| 4,143,788 | 3/1979 | Rosynek . | |
| 4,146,149 | 3/1979 | Beveridge . | |
| 4,148,410 | 4/1979 | Brown . | |
| 4,211,335 | 7/1980 | Langseder . | |
| 4,280,427 | 7/1981 | Potts . | |
| 4,289,251 | 9/1981 | Maliszewski | 220/269 |
| 4,363,419 | 12/1982 | Walz, Sr. . | |
| 4,367,996 | 1/1983 | Saunders | 413/14 |
| 4,372,462 | 2/1983 | Dassler et al. . | |
| 4,387,827 | 6/1983 | Ruemer, Jr. . | |
| 4,402,421 | 9/1983 | Ruemer, Jr. . | |
| 4,416,389 | 11/1983 | Wilkinson et al. . | |
| 4,416,390 | 11/1983 | Takeda et al. . | |
| 4,417,668 | 11/1983 | Stolle . | |
| 4,465,204 | 8/1984 | Kaminski et al. | 220/269 |
| 4,485,935 | 12/1984 | Stoffel . | |
| 4,503,989 | 3/1985 | Brown et al. . | |
| 4,511,299 | 4/1985 | Zysset . | |
| 4,530,631 | 7/1985 | Kaminski et al. . | |
| 4,596,342 | 6/1986 | Zysset . | |
| 4,804,104 | 2/1989 | Moen . | |
| 4,930,658 | 6/1990 | McEldowney . | |

FOREIGN PATENT DOCUMENTS

00091A1 12/1978 United Kingdom .

*Primary Examiner*—Stephen Marcus
*Assistant Examiner*—Nova Stucker
*Attorney, Agent, or Firm*—Tilton, Fallon, Lungmus

[57] ABSTRACT

An easy open can end is disclosed having an attached tear strip across a portion of the can end outlined by a score line, and a round-shaped pull tab secured to the can end adjacent the attached tear strip, the pull tab including a nose portion having a clevis formed in an offset location relative to the pull tab's longitudinal centerline, the can end including a pivot ridge member formed in a centered position relative to the logitudinal centerline of the attached pull tab for assisting in maximizing the offset forces applied by the pull tab's nose portion. The offset clevis operates to create reduced opening forces when opening the can end, including a reduced initial "pop" pressure and a reduced "tear" pressure. These reduced forces result by having the offset clevis cause the initial "pop" opening to occur along only one side of the tear strip's score line and then the opening tear occurs sequentially along the remainder of the score line. This permits use of a score line of reduced depth, thereby leaving additional residual metal at the score line area, which increased residual metal results in less can leakage due to less incidents of unwanted score line fracture. The present invention's offset clevis tab pull is usable with can ends formed of steel and aluminum.

8 Claims, 3 Drawing Sheets

Fig. 1
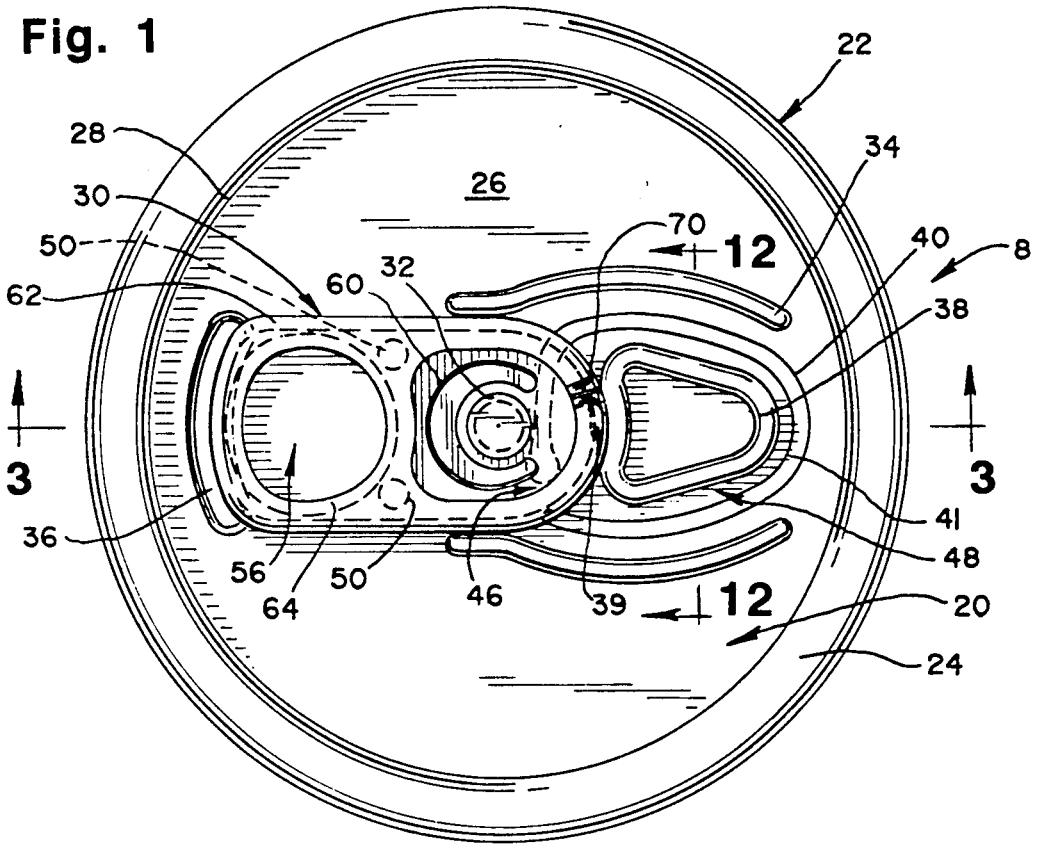
Fig. 2
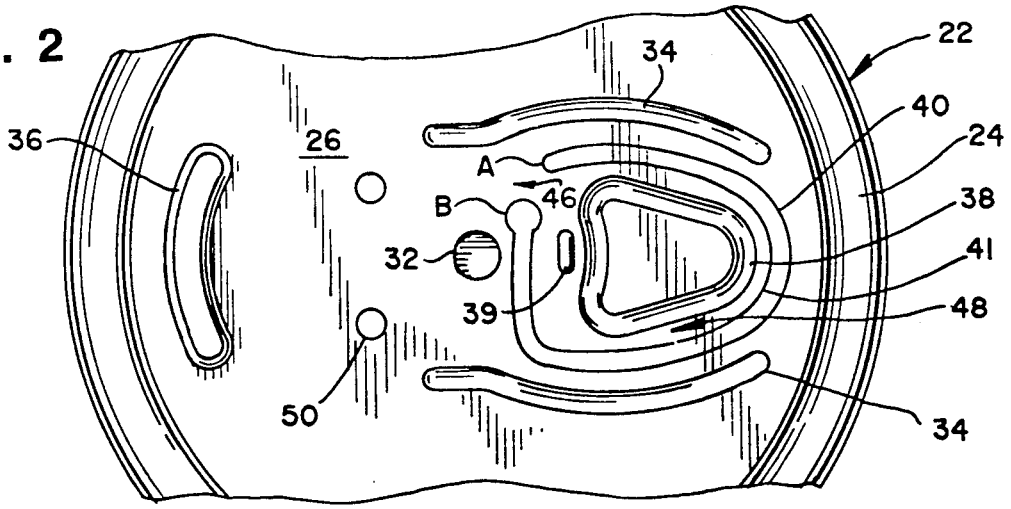
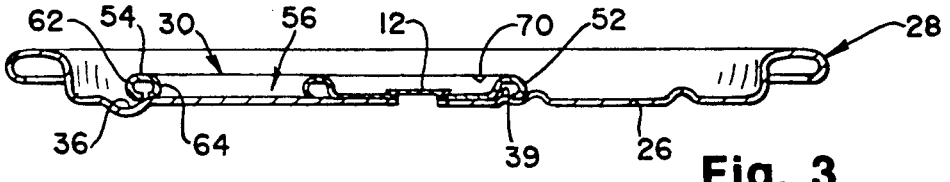
Fig. 3

Fig. 4
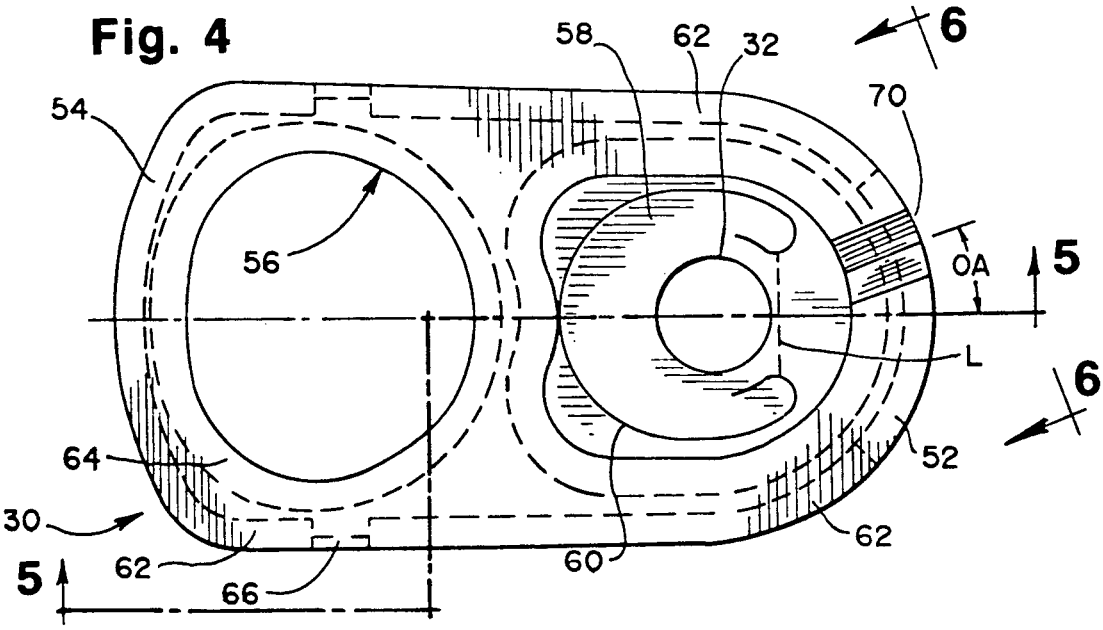
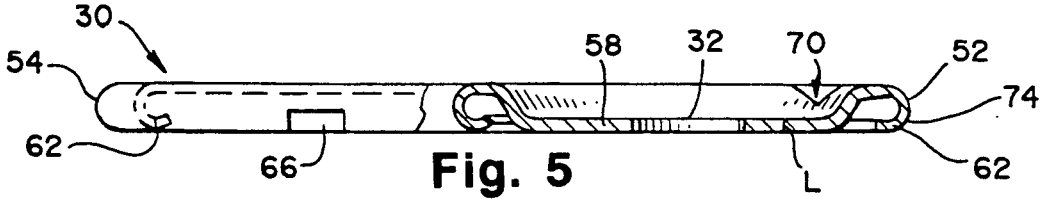
Fig. 5
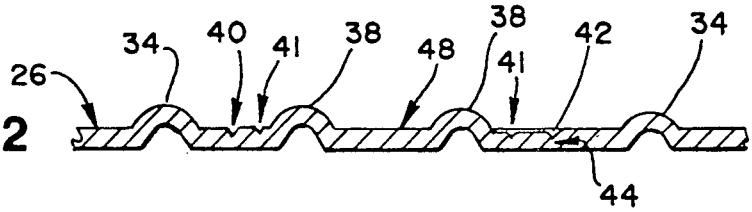
Fig.12
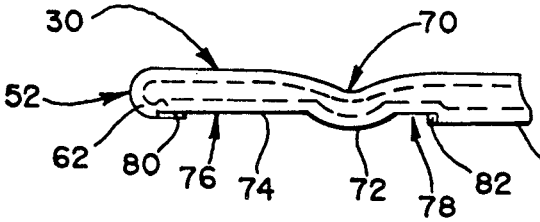
Fig. 6
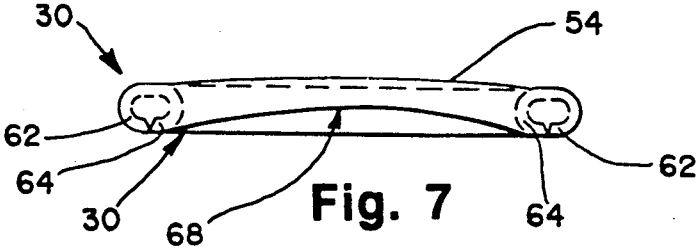
Fig. 7

EASY OPEN ECOLOGY END FOR CANS

FIELD OF THE INVENTION

This invention relates to pull tabs for metallic easy-open can ends or the like, and more specifically to easy-open cans end where the pull tab remains attached to the can end after opening.

BACKGROUND OF THE INVENTION

There have been numerous advances in the easy-open can end field. Many relate to methods of forming such can ends or forming the score lines, i.e., the tear strip's tear line. Others relate to designs for the pull tab rings, their method of attachment to the can end, and the interaction between the two during opening. Other known devices relate to specific methods for forming the pull tab rings, or the shape of the score lines against which the pull tabs operate to open the can. However, all known easy-open can ends are deficient in that they require use of excessive pull tab forces to fully open the can end.

More specifically, the typical easy-open ecology can end, i.e., one where the pull tab ring remains attached to the metal can end after opening has occurred, requires an excessively deep score line in the can end metal. This is required to permit easy opening of the tear strip portion simultaneously along generally both sides of the U-shaped score line during opening. However, this has often resulted in inadvertent fractures of the can end along the score line, such as by internal forces or even by external forces directed to the can end, with attendant can contents leakage.

SUMMARY OF THE INVENTION

The present invention overcomes these prior art problems by utilizing an ecology-type, i.e., attached, round-shaped pull tab ring that has a nose portion formed with a clevis formed at an offset location so as to reduce the forces required to open the can end. A pivot ridge formed in the can end and lying in a centered location under the tab's nose portion cooperates with the tab's off-centered clevis to focus the tab's initial applied force, i.e., the "pop" pressure, onto only one side of the associated score line, rather than across the entire can end surface about the generally U-shaped score line. Since the initial opening pressure applied by the off-centered clevis is directed to and along only one side of the score line, the amount of pressure required to "pop" open the can end is significantly reduced. The remaining force, i.e., the "tear" pressure, which is required to completely open the can end along the score line is also reduced because the tear force is thereafter sequentially focused along the can end score line remaining untorn. Thus, rather than having to pull against the residual metal of the entire score line, the tear created by the present invention's offset clevis follows the can end cut from the initial "pop" opening around the entire score line to the opposite side of the opening thereby fully opening the can end, but with much less required forces.

Also, since less opening forces are required, the present invention permits use of a heavier score residual in the can end. That is, a score line of less depth only need be cut through the can end's thin metal sheet material, as compared to the deeper cuts required in prior art can ends having a centered opening clevis or no clevis whatsoever on the ring tab's nose portion. This extra residual material remaining at the score line reduces incidents of inadvertent score line fracture and can leakage. Further, the offset tab clevis of the present invention can be used with can ends formed of steel and aluminum.

Thus, it is an object of the present invention to provide an easy-open ecology can end which requires reduced forces for opening.

It is a further object of the present invention to provide an easy-open can end where a relatively thick residual of score line material is present, to thereby reduce incidents of inadvertent score line fracture and resultant can leakage.

It is a still further object to provide a pull ring tab having an offset nose clevis to direct the can opening forces to only one side of the associated tear strip.

The means by which the foregoing and other objects of the present invention are accomplished and the manner of their accomplishment will be readily understood from the following specification upon reference to the accompanying drawings, in which:

FIG. 1 is a top plan view of a can end and pull tab utilizing the present invention;

FIG. 2 is a bottom plan view of the can end of FIG. 1;

FIG. 3 is a side view of the can end of FIG. 1;

FIG. 4 is an enlarged top plan view of the novel pull tab of FIG. 1;

FIG. 5 is a side view of the pull tab of FIG. 4;

FIG. 6 is a nose end view, viewed along lines 6—6 of FIG. 4, showing the offset clevis structure of the present pull tab;

FIG. 7 is a rear end view of the pull tab of FIG. 4;

FIG. 12 is an enlarged side section view, taken along lines 12—12 of FIG. 1 of the can end plate structure.

DESCRIPTION OF THE PREFERRED EMBODIMENT

Figure 8:
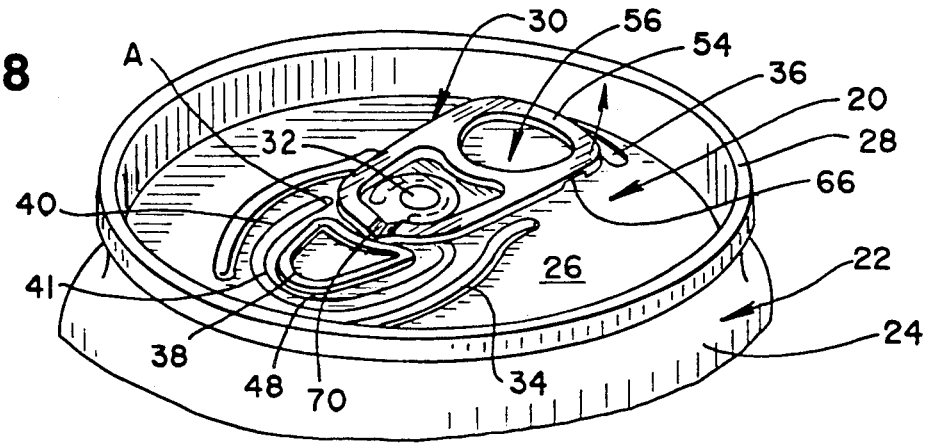
FIGS. 8-11 are a series of top perspective views, viewed generally in the direction of line 8 of FIG. 1, showing in progression how the novel pull tab of the present invention operates to open the can end.

Having reference to the drawings, wherein like reference numerals indicate corresponding elements, there is shown in FIG. 1 an illustration of the top end 20 of a can, generally denoted by reference number 22, having a side wall 24, can end plate 26, and a rolled crimp joint 28 joining side wall 24 to end plate 26. A pull ring tab, generally denoted by reference numeral 30, is pivotally secured to can end plate 26, in a plane parallel thereto, by a rivet 32. The can end plate 26 is made of metal, such as steel, for example. Typically such end plates 26 are in the range of from 0.0072" to 0.0105" in thickness.

Plate 26 is formed, such as by stamping, so as to have upwardly-extending reinforcing ridges 34, 34, a downwardly-extending grab depression area 36, an upwardly-extending, generally triangular-shaped reinforcing member 38, an upwardly extending pivot ridge 39, and a pair of partially cut through score lines, namely, a main score line 40, and an anti-fracture score line 41. Main score line 40 (see FIG. 12) is made by a relatively deep, sharp V-cut 42 (such as by stamping) formed partially through the thickness of can end plate 26; the sharp cut 42 leaves a residual thickness 44 of end plate material at main score line 40. The anti-fracture score line 41, as discussed later herein, is cut to a lesser depth than cut 42, and hence has more can end residual. Although not important to the operation of the present invention, the reinforcing ridges 34 34 could be one continuous ridge (not shown).

Typically, in the known prior art constructions, for an end plate 26 made of steel of 0.0083" thickness, for example, the material thickness for score residual 44 was only approximately 0.0018", for example. That was because any such score line cut had to be of sufficient depth for the can end to be easily opened across the entire score line area, i.e., simultaneously along both sides thereof. As discussed below, the score residual 44 at main score line 40 used with the present invention is substantially thicker.

The purpose of anti-fracture score line 41 is to restrict can end material flow during the scoring operation (when main score line 40 is formed) and to maintain the flatness of the scored areas of can end plate 26, all of which is found to assist in opening can end 26 by the novel pull tab 30.

Preferably, as best seen in the end views of FIGS. 1 and 2, the score lines 40, 41 of the present invention are of a generally U-shaped planar design, running from point A to an enlarged area denoted as point B. The present invention is not limited, however, to any specific planar end view configuration of score lines 40, 41.

Figure 11:
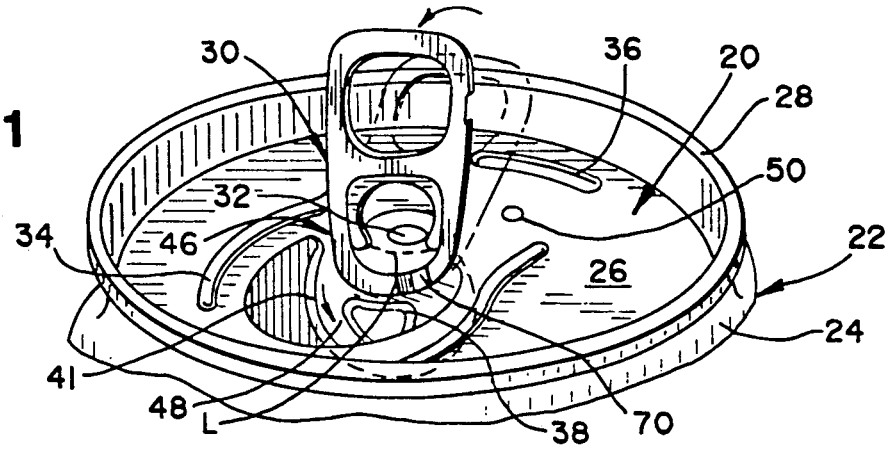

That portion of end plate 26 lying between end points A and B of score lines 40, 41 forms a hinge 46. A tear strip 48 then comprises that portion of can end plate 26 surrounded by the score lines 40, 41 terminating in hinge 46, and includes reinforcing member 38 and pivot ridge 39. Tear strip 48 is actually severed from can end plate 26, during the opening process, along main score line 40, rather than along anti-fracture line 41, which is not severed. A pair of upwardly extending centering pads 50, see FIGS. 1, 2, and 11, are formed into can end plate 26, which pads are used to prevent rotation of pull tab 30 about rivet 32, as discussed further below.

The specially-configured ring pull tab 30 includes a nose portion 52, a grab portion 54 having a finger opening 56, and a partially cut out rivet flange portion 58. The rivet portion 58 is used to hingedly secure ring tab 30 to can end plate 26 via rivet 32, in a plane generally perpendicular to plate 26, such that the outer end of nose portion 52 (see FIG. 3) lies above pivot ridge 39. Rivet portion 58 permits upward and downward hinged movement of ring tab 30 about rivet 32 due to the presence of a generally U-shaped cut line 60 (formed in portion 58), the outer ends of which line 60 are joined by an area of uncut material forming a hinge line in portion 58 generally denoted by reference letter L. Thus, cut line 60 allows rivet portion 58 to act as a hinge for ring tab 30 about hinge line L, whereby lifting movement of tab grab portion 54 (pivoting about rivet portion 58, rivet 32 and hinge line L) forces the tab nose portion 52 generally down against tear strip 48 of can end plate 26, and particularly against pivot ridge 39.

Ring tab 30 is preferably formed from a flat piece of metal, such as tin plate steel, for example, and in the preferred embodiment is formed of a tin plate steel sheet having a thickness of approximately 0.015". For safety purposes as well as for rigidity and strength, tab 30 has all its various exposed edges rolled (see rolled edges 62 and 64). This assures that there are no sharp, i.e., cut metal, edges which might injure the user, and provides sufficient opening strength to nose 52. For ease of fabrication of rolled edge 62, it is formed with a separation area 66. As seen in FIG. 7, the grab portion 54 is formed with a slightly upward arc 68; this assures ease of grasping grab portion 54 within the grab depression area 36 formed on end plate 26.

As seen in FIGS. 1, 4–6, and 8–11, the nose portion 52 of ring tab 30 is provided with a downwardly-extending offset clevis 70, which extends radially outwardly through rolled edge 62 of nose 52. Rather than being formed on the longitudinal centerline of tab 30 (referenced as "CL" in FIG. 4), the offset clevis 70 is purposely located at an offset location, i.e., moved partially around the nose 52 (see FIG. 4) to a non-centered location by offset angle OA (see FIG. 4). Offset clevis 70, thus lies adjacent to one end of pivot ridge 39 on end plate 26. The offset angle OA is preferably approximately 14° off centerline CL.

As best seen in FIG. 6, offset nose clevis 70 is formed, such as by stamping, with a rounded bearing point 72 which extends downwardly from the adjacent lower nose surface 74. This downward extension of bearing point 72 is due to the presence of indented lower nose portions 76, 78 having respective end steps 80, 82. The offset clevis structure, including the indented nose portions 76, 78, the end steps 80, 82, and the offset nose clevis 70 with bearing point 72, all can be readily formed on tab 30 through use of a suitable stamping die (not shown), for example, when forming tab 30. Although in the preferred embodiment the bearing point 72 is shown as being on the same horizontal level with bottom surface 73 of nose 52, point 74 could also extend even lower (or higher) as desired. In any event, the important feature is to have such an offset nose clevis 70 present on tab 30 in a non-centered location, and to have it cooperate with a pivot ridge 39 formed on end plate 26.

Figure 9:
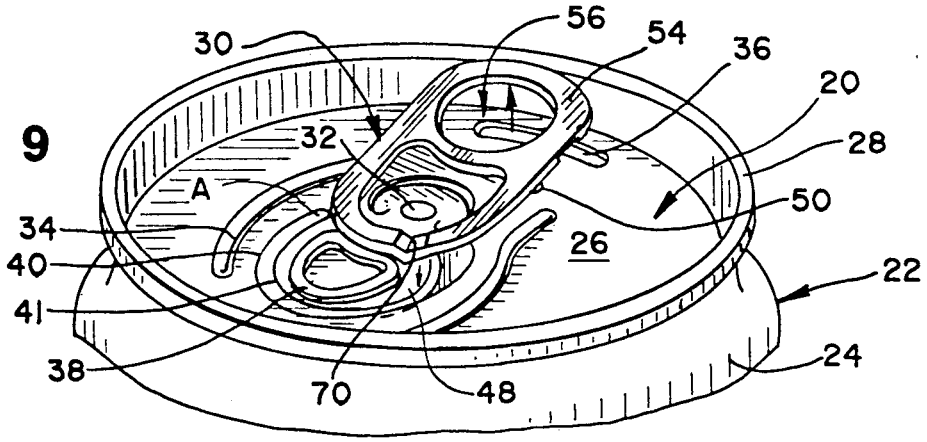
Figure 10:
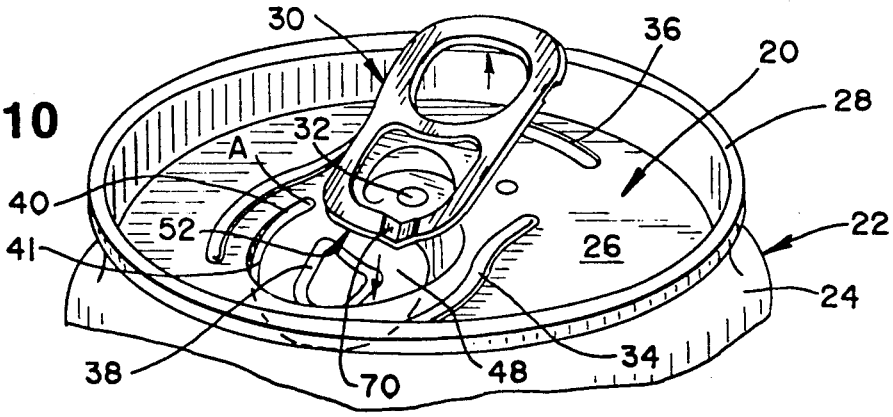

Turning to the operation of improved tab 30, it will be seen in FIGS. 1 and 8–11, that when fastened by rivet 32 and rivet flange portion 58, the centering pads 50, 50 sit between the rolled edges 62, 64 of the ring pull tab 30 and thus, operate to resist rotation of tab 30 about rivet 32. Also, offset clevis 70 on tab nose 52 is positioned so as to lie off one end of pivot ridge 39 (see FIGS. 1 and 3). As seen in FIG. 3, the raised arc portion 68 of tab grab 54 is sufficiently elevated from grab depression 36 of can end plate 26 so that the user is able to readily grab the tab 30 by extending a finger through opening 56. Then, by upward lifting pressure on grab portion 54 (see FIGS. 8 and 9), pressure begins to be applied by tab nose 52 via bearing point 72 of offset clevis 70. At the same time, pivot ridge 39, resting within indented nose portion 76, allows nose portion 52 to pivot thereabout; pivot ridge 39 also acts to prevent nose 52 from moving towards the rivet 32 when tab 30 is lifted. The initial pressure thus created by nose 52 is applied (by offset clevis 70) against that portion of the top surface of can end plate 26 which is adjacent the triangular-shaped reinforcing ridge 38. However, this initial opening force, i.e., force created by tab 30 as the initial "pop" pressure, is applied only along one side of the U-shaped score line 40, namely that side portion of score line 40 that is closest to the offset clevis 70, rather than across the entire opening surface of tear strip 48. Thus, as seen in FIG. 9, the initial "pop" pressure created by offset clevis 70 causes an initial tear opening along that initial side of generally U-shaped score line 40 that is adjacent score line point A.

Thereafter, continued application of lifting force (see lifting force arrow in FIG. 10) to ring tab 30 completes the tear of score line 40; this tear occurs from the initial opening point on the opening side of score line 40 to the very end of score line 40 at point B, and then, the tear continues around the remainder of score line 40 in a sequential fashion until completed. That is, as seen in FIG. 11, the opening tearing action progresses until sufficient applied lifting force has caused score line 40 to be completely torn from score line starting point B to end point A. Through this tearing action then, the tear strip 48 is fully forced downwardly (see FIG. 11), so as to extend internally of can 22. Thereafter, the ring tab 30 can be forcibly lowered (about tab flange portion 58) to it initial position lying flat against pads 50 on can end 26 (see FIGS. 1 and 8).

In this fashion, then, offset clevis 70 on nose 52 has been shown to easily and satisfactorily open can end plate 26. Importantly, because of the presence of offset clevis 70, this opening action occurs with a minimal amount of required opening force, i.e., both the required initial "pop" force as well as the required continued "tearing" force are minimal. For example, in a can made in accordance with the present invention and formed of tin plate steel with a thickness for can end plate 26 of 0.0083", and using a pull ring tab 30 having an offset clevis 70, the initial required "pop" opening force was only approximately 3 lbs. Further, the required "tearing" force to continue the opening of can end 50 was reduced, namely only approximately 4 lbs. Thus, as compared to prior art designs of pull tabs, the novel offset clevis-type pull tab of the present invention means a substantially reduced initial "pop" opening pressure, as well as a substantially reduced continued "tearing" pressure, are all that are required to open the attached can end.

Further, due to the off-centered location of offset clevis 70, the score line 44 can be cut to a reduced depth. This results in a greater thickness for score line residual 44. Thus, in a steel can end plate 26 formed in accordance with the present invention and with the above specifications, it was found that the thickness of the score line residual 44 could be approximately 0.0024" and yet the score line 40 was still easily opened with minimal forces. That residual thickness is substantially greater than that that would be present in the prior art designs of easy open can ends. Importantly, this increased residual thickness 44 at score line 40 has the advantage of less can end leakage and less incidents of unwanted score line fracture.

From the foregoing, it is believed that those skilled in the art will readily appreciate the unique features and advantages of the present invention over previous types of easy-open ecology ends for metal and other type containers. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

We claim:

1. An easy open end plate assembly for cans, comprising in combination:

a can end plate formed of a thin sheet material and having a configured score line partially cut through the thickness of said end plate so as to define a tear strip portion, said partial cut score line leaving a score residual of said sheet material in said can end plate;

a ring pull tab member having grab portion at one end, a nose portion at another end, and an intermediate hinge portion hingedly secured to said can end plate so that said nose portion lies adjacent said tear strip portion;

a clevis member formed on said nose portion at a location offset from the longitudinal centerline of said ring pull tab member, whereby said offset clevis member is operable, when a lifting force is placed on said grab portion, to direct the initial opening force of said nose portion along only one side portion of said score line so as to initially open said can end plate, and thereafter said offset clevis member causes a sequential tearing of the remainder of said score line until said tear strip is fully opened, thereby resulting in minimal opening forces, whereby said score residual can be of sufficient thickness to minimize inadvertent fracture of said score; and a pivot ridge member formed in said can end plate so as to extend towards said nose portion adjacent the longitudinal centerline thereof, said pivot ridge member being aligned generally transverse of said nose portion, whereby said pivot ridge member permits said nose portion to pivot thereabout in a direction offset of said longitudinal centerline so as to assist said offset clevis member in maximizing the initial opening force provided by said offset clevis member along said one side portion of said score line.

2. The invention of claim 1, wherein for said thin sheet material having a thickness of approximately 0.0083 inches, said score residual is approximately 0.0024 inches in thickness.

3. The invention of claim 1, wherein said configured score line is generally U-shaped so that two opposite side portions of said score line are presented to said nose portion, said offset clevis member operable to direct said initial opening force against only one of said opposite score line side portions.

4. The invention of claim 1, wherein said offset clevis member comprises a downwardly extending indentation formed in said nose portion along an offset angle relative to said longitudinal centerline, said offset clevis member being aligned generally radially outwardly of said nose portion.

5. The invention of claim 1, and a round-shaped, downwardly-extending bearing point formed on the lower leading edge of said offset clevis member.

6. The invention of claim 5, wherein said downwardly-extending bearing point is surrounded on each side thereof by indented portions formed in the lower surface of said nose portion, whereby said bearing point extends downwardly to the same level, relative to said can end plate, as the remaining lower surface portions of said nose portion.

7. The invention of claim 4, wherein said offset angle is approximately 14 degrees.

8. An improved ring pull tab for opening a can end plate of the type having a score line partially cut therethrough, the score line defining a tear strip to be opened and having at least two score line side portions, the ring pull tab being affixed to the can end plate, the improvement comprising:

a ring grab portion for applying a lifting force to said pull tab;

a nose portion operably to engage said can end plate adjacent said score line to tear open said tear strip;

an integral hinged portion formed intermediate said ring grab portion and said nose portion and hingedly secured to said can end plate;

a downwardly-extending clevis member formed on said nose portion at a location offset from the longitudinal centerline thereof, said clevis member operable to initially engage only one of said score line side portions so as to create an initial opening in said can end plate along said one score line side portion, and thereafter to create a sequential opening tear in the remainder of said score line so as to fully open said tear strip with a minimal amount of required opening forces; and a pivot ridge member formed on said can end plate so as to extend towards said nose portion adjacent said longitudinal centerline, said pivot ridge member being aligned generally transversely of said nose portion, whereby said pivot ridge member permits said nose portion to pivot thereabout in a noncenterline direction so as to assist said offset clevis member in maximizing the initial opening force created by said offset clevis member against said one score line side portion.

* * * * *

UNITED STATES PATENT AND TRADEMARK OFFICE

CERTIFICATE OF CORRECTION

PATENT NO. : 5,129,541

DATED : July 14, 1992

INVENTOR(S) : Lee R. W. Voigt et al

It is certified that error appears in the above-identified patent and that said Letters Patent is hereby corrected as shown below:

Column 6, line 3, after "having" insert --a--, and

Column 6, line 21, after "score" insert --line--.

Signed and Sealed this

Twenty-fourth Day of August, 1993

Bruce Lehman

*Attest:*

BRUCE LEHMAN

*Attesting Officer*

*Commissioner of Patents and Trademarks*